US011177094B2

(12) United States Patent
Fitch

(10) Patent No.: US 11,177,094 B2
(45) Date of Patent: Nov. 16, 2021

(54) CENTRAL LOCKING DUAL ILLUMINATION SWITCH

(71) Applicant: Carling Technologies, Inc., Plainville, CT (US)

(72) Inventor: Trevor Fitch, Stuart, FL (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 16/948,449

(22) Filed: Sep. 18, 2020

(65) Prior Publication Data

US 2021/0098213 A1 Apr. 1, 2021

Related U.S. Application Data

(60) Provisional application No. 62/907,081, filed on Sep. 27, 2019, provisional application No. 62/907,047, filed on Sep. 27, 2019.

(51) Int. Cl.

| | |
|---|---|
| ***H01H 9/24*** | (2006.01) |
| ***H01H 23/14*** | (2006.01) |
| ***H01H 23/26*** | (2006.01) |

(52) U.S. Cl.

CPC ..... *H01H 23/145* (2013.01); *H01H 9/24* (2013.01); *H01H 23/26* (2013.01); *H01H 2221/016* (2013.01)

(58) Field of Classification Search

CPC ..... H01H 23/145; H01H 23/26; H01H 23/30; H01H 23/00; H01H 9/24; H01H 9/282; H01H 2221/016; H01H 3/20

See application file for complete search history.

(56) References Cited

U.S. PATENT DOCUMENTS

| | | | | |
|---|---|---|---|---|
| RE30,273 | E | 5/1980 | Grebner et al. | |
| 5,045,648 | A | 9/1991 | Fogleman, Sr. | |
| 7,468,492 | B2 * | 12/2008 | Lai | H01H 23/16 200/43.11 |
| 7,868,261 | B2 | 1/2011 | Gauzin et al. | |
| 9,443,679 | B2 * | 9/2016 | Cassarino | H01H 23/143 |
| 9,859,074 | B1 * | 1/2018 | Martinez | H01H 9/28 |

FOREIGN PATENT DOCUMENTS

| | | | | |
|---|---|---|---|---|
| DE | 4422475 | 1/1996 | | |
| DE | 10030275 A1 * | 2/2001 | | H01H 3/20 |

* cited by examiner

*Primary Examiner* — Vanessa Girardi
(74) *Attorney, Agent, or Firm* — Forge IP, PLLC

(57) ABSTRACT

A rocker switch assembly includes a housing having at least one bracket with a bracket stop formed therein, and a rocker actuator pivotably mounted on the housing. At least one wedge lock is pivotably mounted on the rocker actuator, the wedge lock pivotable between a locked position in which the wedge lock engages the bracket stop formed in the bracket, thereby preventing pivoting of the rocker actuator with respect to the housing in at least one direction, and a retracted position in which the wedge lock is disengaged from the bracket stop formed in the bracket so as to allow for pivoting of the rocker actuator with respect to the housing. A lock release button is also provided, actuation of which from a resting position to a release position causes the wedge lock to move to the retracted position.

23 Claims, 6 Drawing Sheets

CENTRAL LOCKING DUAL ILLUMINATION SWITCH

FIELD OF THE INVENTION

The present invention relates generally to rocker switch assemblies, and more specifically, to locking rocker switch assemblies that require manipulation of a button, slide, lever or the like in order to move the actuator out of at least one locked position or into at least one locked-out position, so as to inhibit unintentional manipulation of the switch out of the locked position(s) or into the locked-out position(s).

BACKGROUND OF THE INVENTION

Rocker switch assemblies are well known, and are widely available in various configurations.

Two-position rocker switches, for example, are widely used to provide discrete on/off switches that allow a user to easily determine if the switch is active or not. In an off position, a two-position rocker switch prevents any flow of electricity, or the flow of an electric signal. When the user of the switch activates the rocker switch, a connection is made allowing for the flow of electricity, or of an electric signal. These types of two-position rocker switches have many applications; common applications include light switches, general power switches, and switches in circuit breakers.

Three-position rocker switches are also widely used to provide the ability for a user to choose from between three operating states, or between two operating states and an off state. For example, a three-position rocker switch may allow a user to turn a device off, to a low speed operating state or to a high speed operating state. Numerous other uses are also well known.

During operation of a rocker switch, any activation, or deactivation of the switch, by moving the rocker, causes a mechanical movement inside of the housing. When the user activates the switch, the portion of the switch (the rocker actuator) that is outside of the housing is moved. The rocker actuator is connected to a pin, which causes a subsequent movement inside of the housing, either completing or disconnecting one or more circuits (activating or deactivating the switch and/or switching between two or more operating states).

Locking rocker switch assemblies are also well known. Such switches lock the rocker actuator in a particular position and/or lock the rocker actuator out of being switched to a particular position unless some purposeful user manipulation is performed. The intent of these designs is to inhibit accidental or inadvertent switching into or out of the aforementioned particular position, but to readily allow such switching when desired.

However, with known assemblies of this type, it is often difficult, due to the configuration of the locking mechanism, to also provide such assemblies with illumination mechanisms. It is particularly difficult to provide such illumination mechanisms on both ends of the rocker switch actuator if/when such is desired.

This present invention provides a mechanism of locking a rocker switch assembly in multiple configurations that allows space for lighting to be used on both ends of the rocker actuator. The switch assembly can be a two-position or three-position switch, and the locking rocker actuator (100) can be locked in the "left" position (shown in FIG. 1A), the "middle" position (shown in FIG. 1B), and/or the "right" position (shown in FIG. 1C) in the case of a three-position switch, or in the "left" position (shown in FIG. 1A) and/or the "right" position (shown in FIG. 1C) in the case of a two-position switch. In particular, the inventive configuration resulted from designing a secure lock that would not limit where lighting elements can be used.

SUMMARY OF THE INVENTION

In accordance with one embodiment of the present invention, a rocker switch assembly includes a housing assembly having at least one bracket, the at least one bracket having a bracket stop formed therein, and a rocker actuator pivotably mounted on the housing assembly so as to be pivotable between at least two positions with respect to the housing assembly. At least one wedge lock is pivotably mounted on the rocker actuator, the at least one wedge lock pivotable between a locked position wherein the at least one wedge lock engages the bracket stop formed in the at least one bracket, thereby preventing pivoting of the rocker actuator with respect to the housing assembly in at least one direction, and a retracted position wherein the at least one wedge lock is disengaged from the bracket stop formed in the at least one bracket so as to allow for pivoting of the rocker actuator with respect to the housing assembly. A lock release button is also provided, actuation of which from a resting position to a release position causes the at least one wedge lock to move to the retracted position.

In some embodiments, the at least one wedge lock is further pivotable to a resting position when the lock release button is in its resting position, in which resting position the at least one wedge lock is biased against the at least one bracket, but not engaged with the bracket stop formed in the at least one bracket.

In some embodiments, a biasing member is provided, which urges the lock release button toward the resting position thereof. In certain of these embodiments, the biasing member further urges the at least one wedge lock toward the at least one bracket. In certain embodiments, the biasing member comprises a compression spring disposed between the rocker actuator and the lock release button. In some embodiments, the at least one wedge lock is pivotably connected to the lock release button so as to be in operable communication therewith.

In some embodiments, the at least one wedge lock comprises at least two wedge locks, wherein at least one wedge lock is disposed toward a first side of the rocker actuator with respect to a point about which the rocker actuator pivots with respect to the housing assembly, and wherein at least one wedge lock is disposed toward a second side of the rocker actuator, opposite to the first side of the rocker actuator, with respect to the point about which the rocker actuator pivots with respect to the housing assembly. In certain of these embodiments, the at least one wedge lock comprises at least four wedge locks, wherein at least two wedge locks are disposed toward a first side of the rocker actuator with respect to the point about which the rocker actuator pivots with respect to the housing assembly, and wherein at least two wedge locks are disposed toward a second side of the rocker actuator, opposite to the first side of the rocker actuator, with respect to the point about which the rocker actuator pivots with respect to the housing assembly.

In some embodiments, the rocker actuator is pivotably mounted on the housing assembly so as to be pivotable between the following two positions with respect to the housing assembly: a position tilted toward a first side and a position tilted toward a second side. In certain of these embodiments, the at least one wedge lock comprises at least one wedge lock mounted toward the second side of the rocker actuator, such that the rocker actuator is locked in the position tilted toward the first side when moved thereto. In certain embodiments, the at least one wedge lock comprises at least one wedge lock mounted toward the first side of the rocker actuator, such that the rocker actuator is locked in the position tilted toward the second side when moved thereto. In certain embodiments, the at least one wedge lock comprises at least one wedge lock mounted toward the first side of the rocker actuator and at least one wedge lock mounted toward the second side of the rocker actuator, such that the rocker actuator is locked in the position tilted toward the second side when moved thereto and is locked in the position tilted toward the first side when moved thereto.

In some embodiments, the rocker actuator is pivotably mounted on the housing assembly so as to be pivotable between the following three positions with respect to the housing assembly: a position tilted toward a first side, a middle position and a position tilted toward a second side. In certain of these embodiments, the at least one wedge lock comprises at least one wedge lock mounted toward the second side of the rocker actuator, such that the rocker actuator is locked in the position tilted toward the first side when moved thereto. In certain embodiments, the at least one wedge lock comprises at least one wedge lock mounted toward the first side of the rocker actuator, such that the rocker actuator is locked in the position tilted toward the second side when moved thereto. In certain embodiments, the at least one wedge lock comprises at least one wedge lock mounted toward the first side of the rocker actuator and at least one wedge lock mounted toward the second side of the rocker actuator, such that the rocker actuator is locked in the position tilted toward the second side when moved thereto and is locked in the position tilted toward the first side when moved thereto. In certain embodiments, the at least one wedge lock comprises at least one wedge lock mounted toward the first side of the rocker actuator and at least one wedge lock mounted toward the second side of the rocker actuator, such that the rocker actuator is locked in the middle position when moved thereto. In certain embodiments, the at least one wedge lock comprises at least one wedge lock mounted toward the first side of the rocker actuator, such that the rocker actuator is locked out of movement to the position tilted toward the first side. In certain embodiments, the at least one wedge lock comprises at least one wedge lock mounted toward the second side of the rocker actuator, such that the rocker actuator is locked out of movement to the position tilted toward the second side.

In accordance with another aspect of the present invention, a rocker switch assembly includes a housing assembly comprising at least one bracket, the at least one bracket having a bracket stop formed therein and a rocker actuator pivotably mounted on the housing assembly so as to be pivotable between at least two positions with respect to the housing assembly. At least one wedge lock is pivotably mounted on the rocker actuator, the at least one wedge lock pivotable between a locked position wherein the at least one wedge lock engages the bracket stop formed in the at least one bracket, thereby preventing pivoting of the rocker actuator with respect to the housing assembly in at least one direction, a resting position in which the at least one wedge lock is biased against the at least one bracket, but not engaged with the bracket stop formed in the at least one bracket, and a retracted position wherein the at least one wedge lock is disengaged from the bracket stop formed in the at least one bracket so as to allow for pivoting of the rocker actuator with respect to the housing assembly. A lock release button is pivotably connected to the at least one wedge lock so as to be in operable communication therewith, wherein actuation of the lock release button from a resting position to a release position causes the at least one wedge lock to move to the retracted position, and a biasing member urges the lock release button toward the resting position thereof and urges the at least one wedge lock toward the at least one bracket.

In some embodiments, the biasing member comprises a compression spring disposed between the rocker actuator and the lock release button.

In some embodiments, the at least one wedge lock comprises at least two wedge locks, wherein at least one wedge lock is disposed toward a first side of the rocker actuator with respect to a point about which the rocker actuator pivots with respect to the housing assembly, and wherein at least one wedge lock is disposed toward a second side of the rocker actuator, opposite to the first side of the rocker actuator, with respect to the point about which the rocker actuator pivots with respect to the housing assembly. In certain of these embodiments, the at least one wedge lock comprises at least four wedge locks, wherein at least two wedge locks are disposed toward a first side of the rocker actuator with respect to the point about which the rocker actuator pivots with respect to the housing assembly, and wherein at least two wedge locks are disposed toward a second side of the rocker actuator, opposite to the first side of the rocker actuator, with respect to the point about which the rocker actuator pivots with respect to the housing assembly.

In some embodiments, the rocker actuator is pivotably mounted on the housing assembly so as to be pivotable between the following two positions with respect to the housing assembly: a position tilted toward a first side and a position tilted toward a second side. In some embodiments, the rocker actuator is pivotably mounted on the housing assembly so as to be pivotable between the following three positions with respect to the housing assembly: a position tilted toward a first side, a middle position and a position tilted toward a second side.

This present invention thus provides a rocker switch assembly that may be locked in multiple configurations and yet that also allows space for lighting to be used on both ends of the rocker actuator.

Other features and advantages of the invention will become more apparent from consideration of the following drawing.

DETAILED DESCRIPTION OF THE INVENTION

Figure 1A:
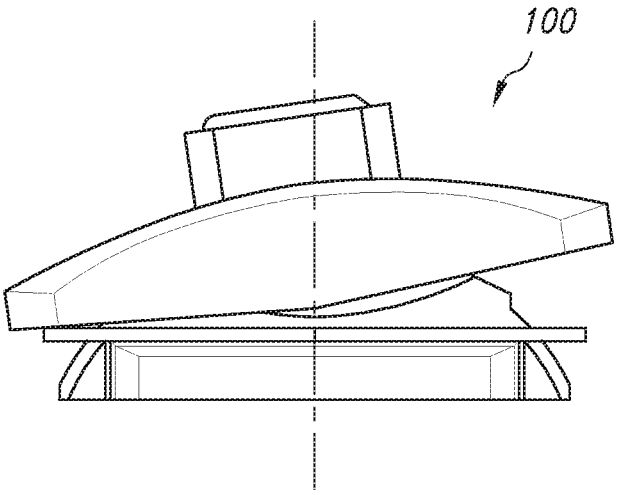
(PRIOR ART) FIG. 1A
FIGS. 1A-1C are side schematic views generally showing various positions of the rocker actuator portion of a three position rocker switch assembly (all of FIGS. 1A-1C) or of a two-position rocker switch assembly (FIGS. 1A and 1C only)
Figure 1B:
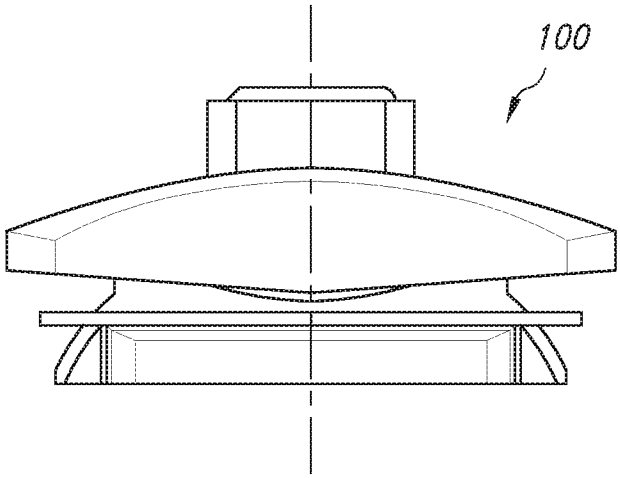
(PRIOR ART) FIG. 1B
Figure 1C:
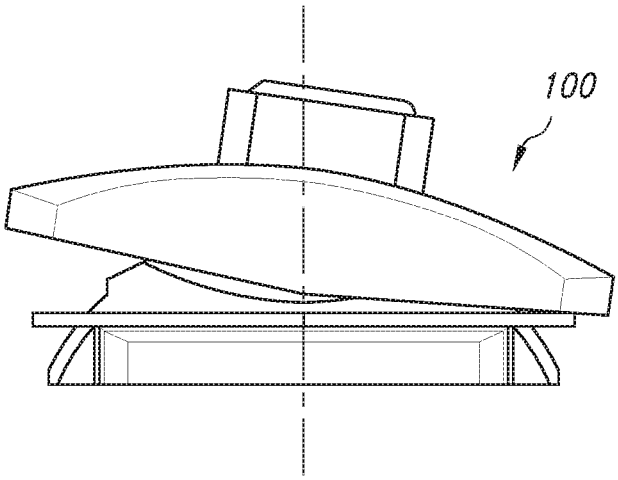
(PRIOR ART) FIG. 1C
Figure 2:
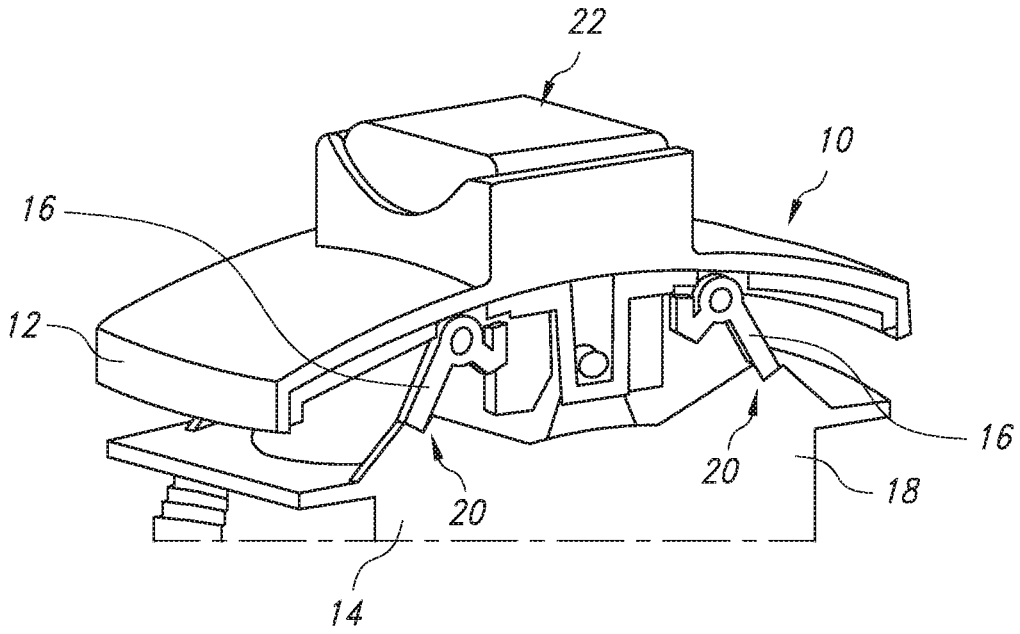
FIG. 2 is a partially cut away side isometric view of a rocker switch assembly in accordance with an exemplary embodiment of the present invention employing "short" wedge locks.

Referring now to FIG. 2, shown is an exemplary configuration of a rocker switch assembly (10) in accordance with the present invention. As is the case with traditional rocker switches, the inventive rocker switch assembly employs a rocker switch actuator (12) pivotably mounted to a housing assembly (14) in a generally conventional manner. Indeed, the inventive rocker switch assembly (10) is similar to traditional rocker switches in a number of respects (including, in particular, the configuration of the electrical contacts internal to the switch assembly). Since such traditional designs are widely used and extremely well known to those skilled in the art, a detailed explanation of common components is not provided herein for the sake of simplicity. Instead, only those distinctions between the inventive designs and traditional rocker switches are described in detail and highlighted in the accompanying Figures.

With this in mind, it should be noted that, unlike typical designs, the inventive rocker switch assembly (10) of the present invention includes one or more wedge locks (16), themselves pivotably mounted to the rocker switch actuator (12). The wedge locks (16) are acted upon by a biasing member, such as a spring or the like (as described more fully below), that makes the wedge locks (16) naturally biased to rotate downward—i.e., toward the housing assembly (14)—into sliding engagement with at least one bracket (18) provided on the housing assembly (14).

In the embodiment illustrated in FIG. 2, two wedge locks (16) are shown, although a greater or lesser number thereof may be provided. For example, another pair of wedge locks (16) may be provided on the opposite (not visible) side of the rocker switch actuator (12) in a symmetrical arrangement about a longitudinal plane splitting the rocker switch assembly (10) in half, for a total of four wedge locks (16). Or, if locking in only one position is desired, a single wedge lock (16) may be provided toward only one end of the rocker switch actuator (12). Of, if desired, two locking wedges (16) may be provided in a symmetrical arrangement, as above, but only toward one end of the rocker switch actuator (12), again, if locking in only one position is desired.

As illustrated, each of the brackets (18) is provided with a bracket stop (20) corresponding with each wedge lock (16). The bracket stops (20) are positioned such that the wedge locks (16) engage the bracket stops (20) when the rocker switch actuator (12) is moved to a corresponding position in order to lock the rocker switch actuator (12) into a desired position and/or out of a desired position. Various contemplated options for various locking positions are described further below, as are various options for the configuration of the wedge locks (16).

A lock release button (22) is provided, such that when actuated, the lock release button (22) rotates the wedge locks (16) upwardly, countering the bias member's downward bias of the wedge locks into engagement with the brackets (18), thereby lifting the wedge locks (16) out of engagement with the bracket stops (20).

Figure 3:
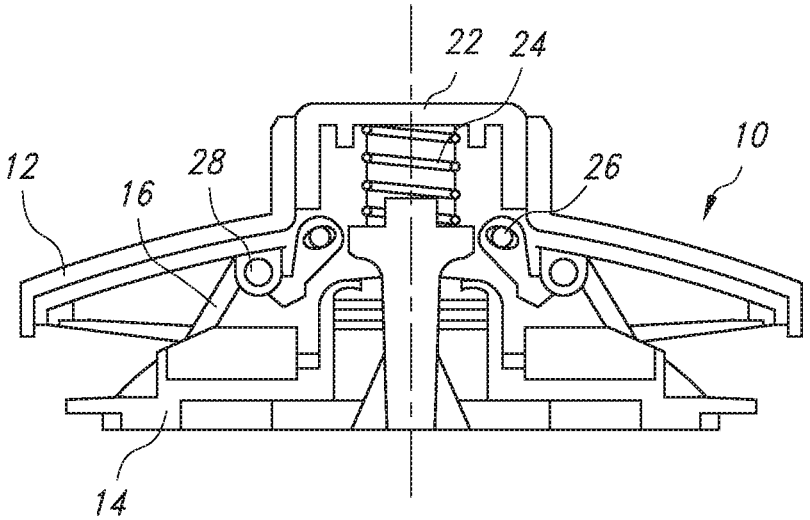
FIG. 3 is a partially cross-sectional side view of the rocker switch assembly of FIG. 2.
Figure 4:
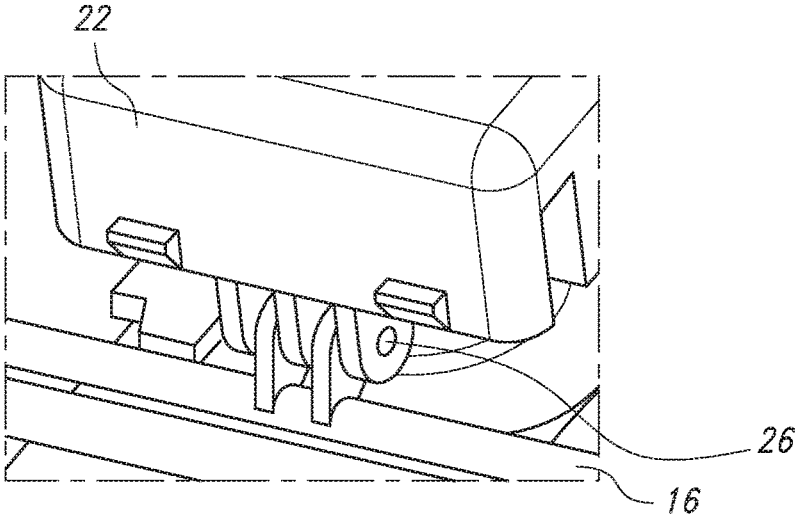
FIG. 4 is an isometric cutaway view of a portion of the rocker switch assembly of FIG. 2.

Referring now to FIGS. 3 and 4, one exemplary configuration is shown wherein the biasing member takes the form of a compression spring (24) disposed to urge the lock release button (22) upwardly (i.e., away from the housing) when not being actuated. Because of the pivotable connection between the lock release button (22) and the wedge locks (16) about a pin (26)—as shown best in FIG. 4—this upward urging of the lock release button (22) by the compression spring (24) caused a corresponding upward urging of the end of the wedge locks (16) engaging the pin (26), which is translated, via pivotable connections (28)—best seen in FIG. 3—to a downward urging of the opposite end of the wedge locks (16) adjacent to the brackets (18).

Figure 5A:
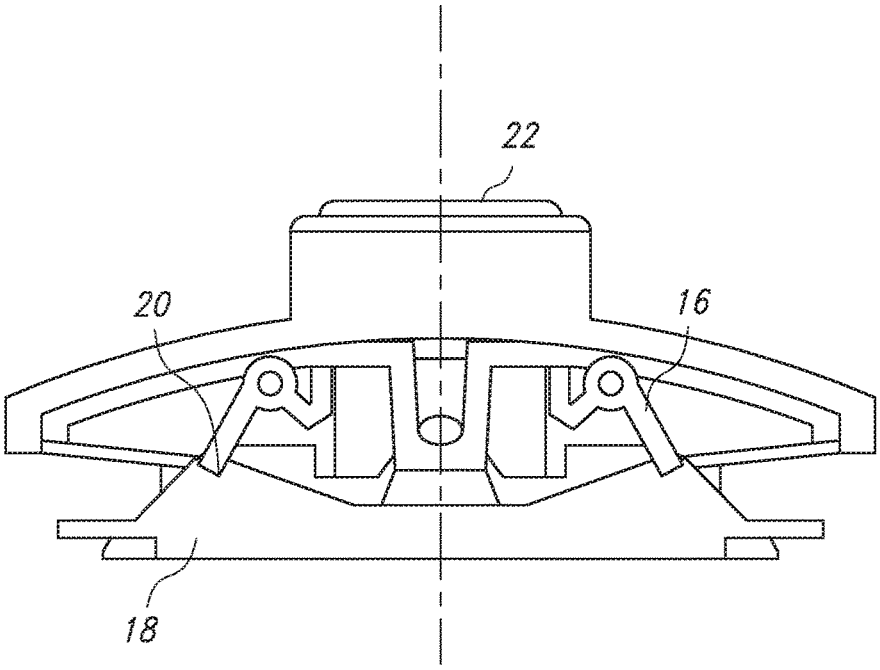
FIGS. 5A and 5B are a partially cross-sectional side views of the rocker switch assembly of FIG. 2 shown in various states of actuation.
Figure 5B:
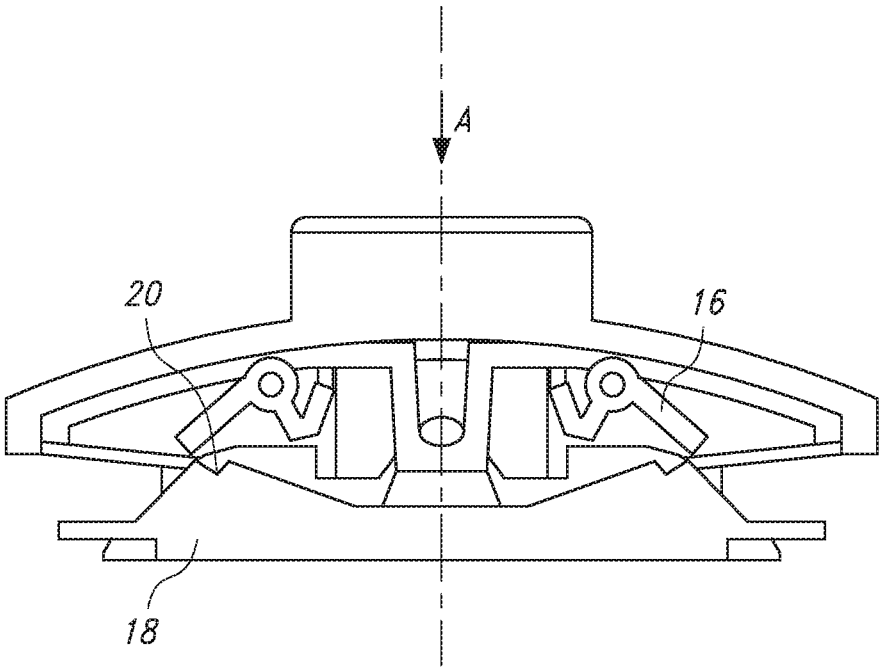

Thus, as shown in FIG. 5A, when the lock release button (22) is urged upwardly by the compression spring (24), the wedge locks (16) are correspondingly urged against the brackets (18), or more specifically in the illustrated case, into the bracket stops (20) of the brackets (18). On the other hand, as shown in FIG. 5B, when the lock release button (22) is pressed by a user (indicated by arrow A), the end of the wedge locks (16) adjacent the brackets (18) are pivoted upwardly so as not to be engageable with the bracket stops (20) of the brackets (18).

As should be apparent to those skilled in the art, however, the biasing member that is configured to urge the wedge locks (16) against the brackets (18) and/or to urge the lock release button (22) upwardly (i.e., away from the housing) when not being actuated may take forms other than compression spring (24) without affecting operation of the inventive assembly. For example, one or more torsion springs may be provided for urging the wedge locks (16) against the brackets (18) and correspondingly to urge the lock release button (22) upwardly, via cooperation between the wedge locks (16) and the lock release button (22). Or some other type of biasing member or combination of biasing members may be employed.

As discussed below in more detail, there are various possible configurations employing the above-described general inventive concepts. More specifically, as discussed above in the case with known rocker switches, it is contemplated that the present invention may comprise either a three-position switch (i.e., having left, middle and right positions) or a two-position switch (i.e., having left and right positions). Moreover, by using either one or two wedge locks, and/or by using wedge locks having different lengths (i.e., "long" or "short" wedge locks), multiple locking configurations are contemplated.

With respect to the afore-described embodiment shown in FIGS. 2-5B, a configuration employing "short" wedge locks (16) is shown. In this embodiment, when the rocker actuator (12) is in a center position, the wedge locks (16) are in engagement with the bracket stops (20) of the brackets (18), as best seen in FIGS. 2 and 5A.

Figure 6:
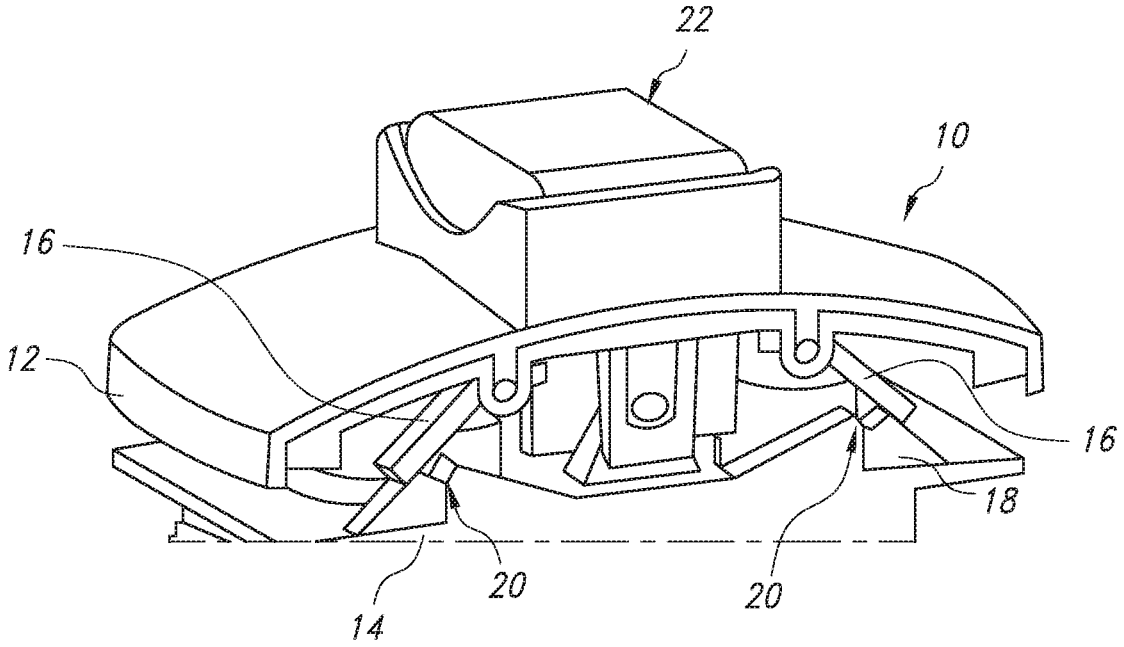
FIG. 6 is a partially cut away side isometric view of a rocker switch assembly in accordance with an exemplary embodiment of the present invention that is similar to the embodiment shown in FIG. 2, but employing "long" wedge locks.
Figure 7A:
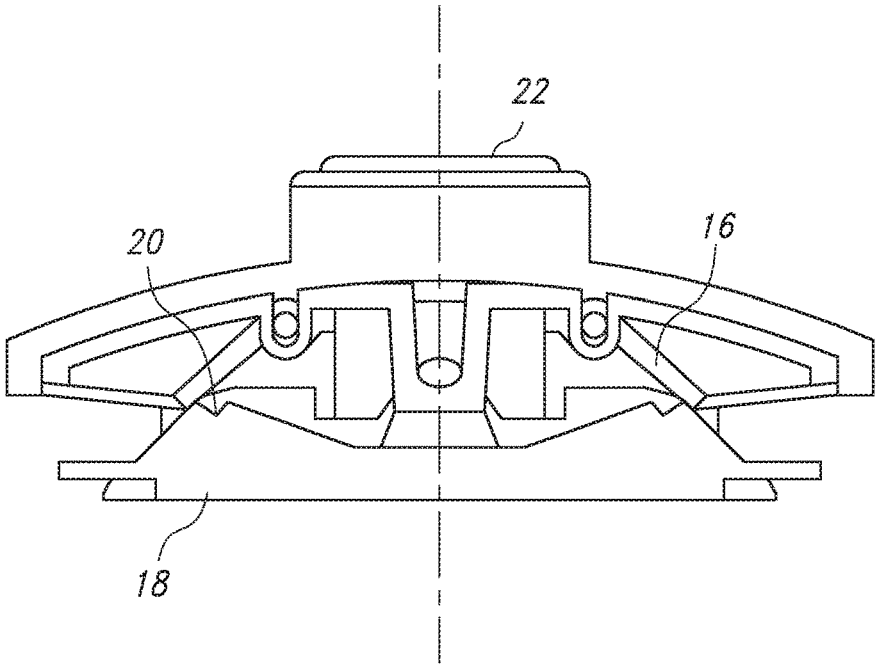
FIGS. 7A and 7B are a partially cross-sectional side views of the rocker switch assembly of FIG. 6 shown in various states of actuation.
Figure 7B:
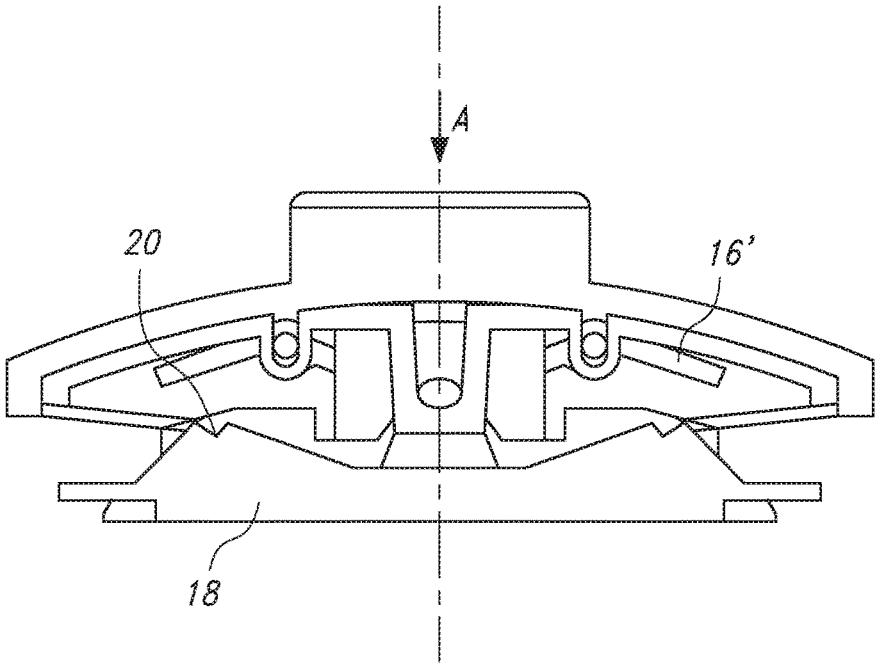

Turning now to FIGS. 6-7B, another embodiment of an inventive rocker switch assembly (10') is shown, in which "long" wedge locks (16') are employed. As best seen in FIGS. 6 and 7A, in this embodiment, when the rocker actuator (12) is in a center position, the wedge locks (16') are not in engagement with the bracket stops (20) of the brackets (18), but rather are urged against the brackets (18) in a sliding engagement. However, the "long" wedge locks (16') do indeed engage the bracket stops (20) when the rocker actuator (12) is moved to its various positions, as is described in more detail below.

In other pertinent respects, the rocker switch assembly (10') shown in FIGS. 6-7B, in which "long" wedge locks (16') are employed, is similar to the rocker switch assembly (10) shown in FIGS. 2-5B, in which "short" wedge locks (16) are employed. In particular, as shown in FIG. 7A, when the lock release button (22) is urged upwardly by the compression spring (24), the wedge locks (16') are correspondingly urged against the brackets (18) in sliding engagement. On the other hand, as shown in FIG. 7B, when the lock release button (22) is pressed by a user (indicated by arrow A), the end of the wedge locks (16') adjacent the brackets (18) are pivoted upwardly so as not to slide against the brackets (18) and to be not engageable with the bracket stops (20) of the brackets (18).

Figure 8A:
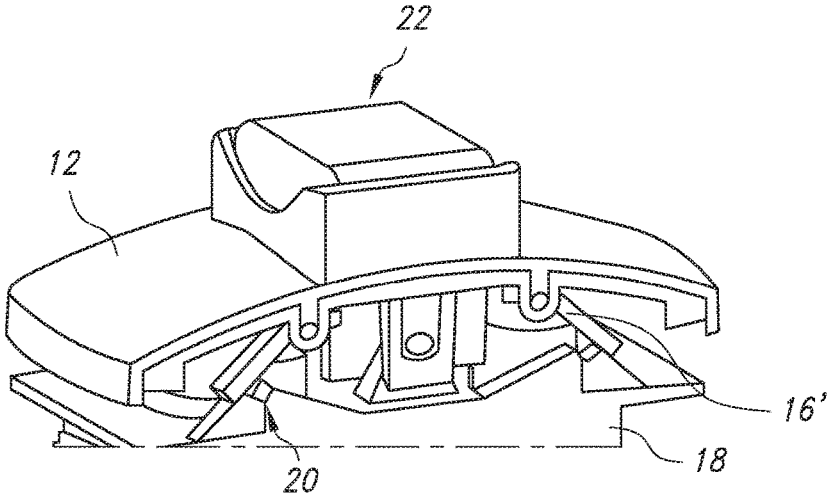
FIGS. 8A-8C are a partially cross-sectional isometric views of the rocker switch assembly of FIG. 6 shown with the rocker actuator portion in various positions and in various states of actuation.
Figure 8B:
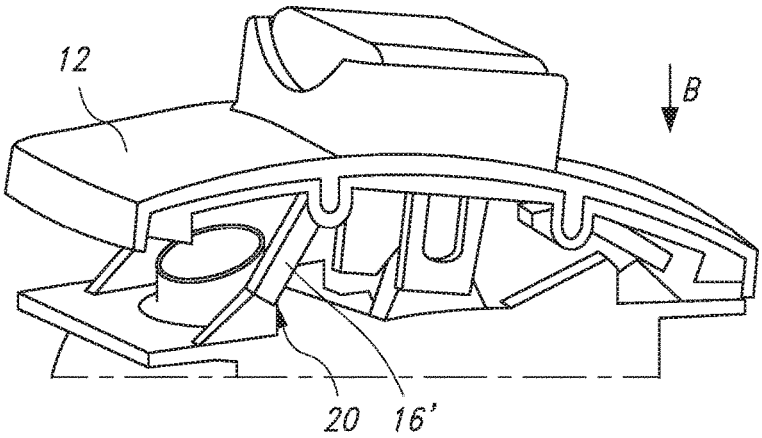
Figure 8C:
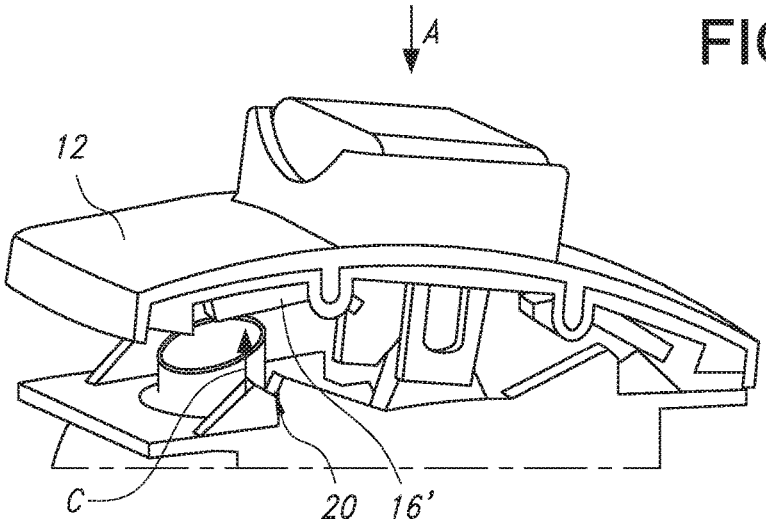

Turning now specifically to FIGS. 8A-8C, in addition to FIGS. 5A, 5B, 7A and 7B, various exemplary options will be discussed in connection with locking operation of both the "long" wedge lock (16') configuration and the "short" wedge lock (16) configuration.

FIGS. 8A-8C specifically show operation of an exemplary "long" wedge lock (16') configuration, as also shown in FIGS. 6, 7A and 7B, Even more specifically, the illustrated embodiment is a three-position switch employing two "long" wedge locks (i.e., one on each side). With this configuration, the switch is freely moveable from the middle position (shown in FIG. 8A) to either the left or right position, and is locked when moved to either of these positions. More specifically, as shown in FIG. 8A, when the rocker actuator (12) is in the middle position, neither wedge lock (16') engages its corresponding bracket stop (20), such that the rocker actuator can be freely moved to either the right position or the left position, with sliding contact occurring between the wedge locks (16') and their corresponding brackets (18).

For example, FIG. 8B shows the switch having been moved to the right position (e.g., by downward force being applied on the right side, as indicated by arrow B). As can be seen, when moved to this position, the left wedge lock (16') engages the left bracket stop (20) of the left bracket (18), such that the rocker actuator (12) is now locked in the right position. When in this position, the right wedge lock (16') still does not engage the right bracket stop (20), such that the right wedge lock (16') is still in sliding engagement with the right bracket (18).

Referring now specifically to FIG. 8C, upon actuation of the lock release button (22), as indicated by arrow (A), however, the left wedge lock (16') is pivoted out of engagement with the left bracket stop (20), as indicated by arrow (C), such that the rocker actuator (12) is moveable back to the middle position (shown in FIG. 8A), from where it is again freely moveable to either the left or right positions.

As noted above, there are multiple contemplated embodiments employing the above-described general inventive concepts, including various embodiments of a three-position switch (i.e., having left, middle and right positions, with respect to the orientation shown in FIGS. 8A-8C). Moreover, by using either one or two wedge locks, and/or by using wedge locks having different lengths (i.e., "long" or "short" wedge locks), multiple locking configurations are contemplated. Following are six exemplary locking configurations of a three-position switch:

a. Lock only in left position (long wedge lock mounted on right side).
   Depress lock release button to allow return to middle position or right position.
b. Lock only in right position (long wedge lock mounted on left side).
   Depress lock release button to allow return to middle position or left position.
c. Lock in both left position and right position (long wedge locks mounted on both right side and left side)—(NOTE: this is embodiment illustrated in FIGS. 6, 7A, 7B and 8A-8C).
   Depress lock release button to allow return to middle position.
d. Lock in middle position not allowing left position and right position (short wedge locks mounted on both right side and left side)—(NOTE: this is embodiment illustrated in FIGS. 2, 3, 5A and 5B).
   Depress lock release button to allow movement to left position.
   Free movement back to middle position from left position and locks in middle position.
   Depress lock release button to allow movement to right position.
   Free movement back to middle position from right position and locks in middle position.
e. Lock in middle position not allowing left position (short wedge lock on left side).
   Depress lock release button to allow movement to left position.
   Free movement back to middle position from left position locks out left position.
   Free movement from middle position to right position at all-times and vice versa.
f. Lock in middle position not allowing right position (short wedge lock on right side).
   Depress lock release button to allow movement to right position.
   Free movement back to middle position from right position locks out right position.
   Free movement from middle position to left position at all-times and vice versa.

As also noted above, there are multiple contemplated embodiments employing the above-described general inventive concepts, including various embodiments of a two-position switch (i.e., having left and right positions). Following are three exemplary locking configurations of a two-position switch (all of which employ "long" wedge locks):

a. Lock in left position (long wedge lock mounted on right side).
   Depress lock release button to allow return to right position.
b. Lock in right position (long wedge lock mounted on left side).
   Depress lock release button to allow return to left position.
c. Lock in both left position and right position (long wedge locks mounted on both right side and left side).
   Depress lock release button to allow return to left position or right position.

The present invention provides various advantages over previously known designs, including the ability to provide for multiple lock configurations with only slight modifications to the switch assembly. This can be achieved merely by employing wedge locks having two different lengths and/or by varying the position of where the wedge locks are provided (i.e., on the left side, on the right side or on both the left side and the right side). The present invention also facilitates the provision of a lighting mechanism on either or both ends of the central lock (by relying on a very simple and compact locking arrangement, as compared to previously known designs).

Although the invention has been described with reference to a particular arrangement of parts, features and the like, these are not intended to exhaust all possible arrangements or features, and indeed many other modifications and variations will be ascertainable to those of skill in the art.

What is claimed is:

1. A rocker switch assembly comprising:

a housing assembly comprising at least one bracket, said at least one bracket having a bracket stop formed therein;

a rocker actuator pivotably mounted on said housing assembly so as to be pivotable between at least two positions with respect to said housing assembly;

at least two wedge locks pivotably mounted on said rocker actuator, each of said at least two wedge locks pivotable between a locked position wherein each of said at least two wedge locks engages the bracket stop formed in said at least one bracket, thereby preventing pivoting of said rocker actuator with respect to said housing assembly in at least one direction, and a retracted position wherein each of said at least two wedge locks is disengaged from the bracket stop formed in said at least one bracket so as to allow for pivoting of said rocker actuator with respect to said housing assembly;

wherein at least one wedge lock is disposed toward a first side of said rocker actuator with respect to a point about which said rocker actuator pivots with respect to said housing assembly, and wherein at least one wedge lock is disposed toward a second side of said rocker actuator, opposite to the first side of said rocker actuator, with respect to the point about which said rocker actuator pivots with respect to said housing assembly; and a lock release button, actuation of which from a resting position to a release position causes each of said at least two wedge locks to move to the retracted position.

2. The rocker switch assembly of claim 1 wherein each of said at least two wedge locks is further pivotable to a resting position when said lock release button is in its resting position, in which resting position each of said at least two wedge locks is biased against said at least one bracket, but not engaged with the bracket stop formed in said at least one bracket.

3. The rocker switch assembly of claim 1 wherein each of said at least two wedge locks is pivotably connected to said lock release button so as to be in operable communication therewith.

4. The rocker switch assembly of claim 1 wherein said at least two wedge locks comprise at least four wedge locks, wherein at least two wedge locks are disposed toward a first side of said rocker actuator with respect to the point about which said rocker actuator pivots with respect to said housing assembly, and wherein at least two wedge locks are disposed toward a second side of said rocker actuator, opposite to the first side of said rocker actuator, with respect to the point about which said rocker actuator pivots with respect to said housing assembly.

5. The rocker switch assembly of claim 1 further comprising a biasing member urging said lock release button toward the resting position thereof.

6. The rocker switch assembly of claim 5 wherein the biasing member further urges each of said at least two wedge locks toward said at least one bracket.

7. The rocker switch assembly of claim 5 wherein the biasing member comprises a compression spring disposed between said rocker actuator and said lock release button.

8. The rocker switch assembly of claim 1 wherein said rocker actuator is pivotably mounted on said housing assembly so as to be pivotable between the following two positions with respect to said housing assembly: a position tilted toward a first side and a position tilted toward a second side.

9. The rocker switch assembly of claim 8 wherein said at least two wedge locks comprise at least one wedge lock mounted toward the second side of said rocker actuator, such that said rocker actuator is locked in the position tilted toward the first side when moved thereto.

10. The rocker switch assembly of claim 8 wherein said at least two wedge locks comprise at least one wedge lock mounted toward the first side of said rocker actuator, such that said rocker actuator is locked in the position tilted toward the second side when moved thereto.

11. The rocker switch assembly of claim 8 wherein said at least two wedge locks comprise at least one wedge lock mounted toward the first side of said rocker actuator and at least one wedge lock mounted toward the second side of said rocker actuator, such that said rocker actuator is locked in the position tilted toward the second side when moved thereto and is locked in the position tilted toward the first side when moved thereto.

12. The rocker switch assembly of claim 1 wherein said rocker actuator is pivotably mounted on said housing assembly so as to be pivotable between the following three positions with respect to said housing assembly: a position tilted toward a first side, a middle position and a position tilted toward a second side.

13. The rocker switch assembly of claim 12 wherein said at least two wedge locks comprise at least one wedge lock mounted toward the second side of said rocker actuator, such that said rocker actuator is locked in the position tilted toward the first side when moved thereto.

14. The rocker switch assembly of claim 12 wherein said at least two wedge locks comprise at least one wedge lock mounted toward the first side of said rocker actuator, such that said rocker actuator is locked in the position tilted toward the second side when moved thereto.

15. The rocker switch assembly of claim 12 wherein said at least two wedge locks comprise at least one wedge lock mounted toward the first side of said rocker actuator and at least one wedge lock mounted toward the second side of said rocker actuator, such that said rocker actuator is locked in the position tilted toward the second side when moved thereto and is locked in the position tilted toward the first side when moved thereto.

16. The rocker switch assembly of claim 12 wherein said at least two wedge locks comprise at least one wedge lock mounted toward the first side of said rocker actuator and at least one wedge lock mounted toward the second side of said rocker actuator, such that said rocker actuator is locked in the middle position when moved thereto.

17. The rocker switch assembly of claim 12 wherein said at least two wedge locks comprise at least one wedge lock mounted toward the first side of said rocker actuator, such that said rocker actuator is locked out of movement to the position tilted toward the first side.

18. The rocker switch assembly of claim 12 wherein said at least two wedge locks comprise at least one wedge lock mounted toward the second side of said rocker actuator, such that said rocker actuator is locked out of movement to the position tilted toward the second side.

19. A rocker switch assembly comprising:

a housing assembly comprising at least one bracket, said at least one bracket having a bracket stop formed therein;

a rocker actuator pivotably mounted on said housing assembly so as to be pivotable between at least two positions with respect to said housing assembly;

at least two wedge locks pivotably mounted on said rocker actuator, each of said at least two wedge locks pivotable between a locked position wherein each of said at least two wedge locks engages the bracket stop formed in said at least one bracket, thereby preventing pivoting of said rocker actuator with respect to said housing assembly in at least one direction, a resting position in which each of said at least two wedge locks is biased against said at least one bracket, but not engaged with the bracket stop formed in said at least one bracket, and a retracted position wherein each of said at least two wedge locks is disengaged from the bracket stop formed in said at least one bracket so as to allow for pivoting of said rocker actuator with respect to said housing assembly;

wherein at least one wedge lock is disposed toward a first side of said rocker actuator with respect to a point about which said rocker actuator pivots with respect to said housing assembly, and wherein at least one wedge lock is disposed toward a second side of said rocker actuator, opposite to the first side of said rocker actuator, with respect to the point about which said rocker actuator pivots with respect to said housing assembly;

a lock release button pivotably connected to each of said at least two wedge locks so as to be in operable communication therewith, wherein actuation of said lock release button from a resting position to a release position causes each of said at least two wedge locks to move to the retracted position; and a biasing member urging said lock release button toward the resting position thereof and urging each of said at least two wedge locks toward said at least one bracket.

20. The rocker switch assembly of claim 19 wherein the biasing member comprises a compression spring disposed between said rocker actuator and said lock release button.

21. The rocker switch assembly of claim 19 wherein said at least two wedge locks comprise at least four wedge locks, wherein at least two wedge locks are disposed toward a first side of said rocker actuator with respect to the point about which said rocker actuator pivots with respect to said housing assembly, and wherein at least two wedge locks are disposed toward a second side of said rocker actuator, opposite to the first side of said rocker actuator, with respect to the point about which said rocker actuator pivots with respect to said housing assembly.

22. The rocker switch assembly of claim 19 wherein said rocker actuator is pivotably mounted on said housing assembly so as to be pivotable between the following two positions with respect to said housing assembly: a position tilted toward a first side and a position tilted toward a second side.

23. The rocker switch assembly of claim 19 wherein said rocker actuator is pivotably mounted on said housing assembly so as to be pivotable between the following three positions with respect to said housing assembly: a position tilted toward a first side, a middle position and a position tilted toward a second side.

* * * * *